US009643807B2

(12) United States Patent
Ishikawa

(10) Patent No.: US 9,643,807 B2
(45) Date of Patent: May 9, 2017

(54) SHEET FEED DEVICE

(71) Applicant: RISO KAGAKU CORPORATION, Tokyo (JP)

(72) Inventor: Mitunori Ishikawa, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/828,136

(22) Filed: Aug. 17, 2015

(65) Prior Publication Data

US 2016/0046457 A1 Feb. 18, 2016

(30) Foreign Application Priority Data

Aug. 18, 2014 (JP) ..... 2014-165784

(51) Int. Cl.
*B65H 1/22* (2006.01)
*B65H 7/02* (2006.01)
(Continued)

(52) U.S. Cl.
CPC ..... *B65H 7/02* (2013.01); *B65H 1/14* (2013.01); *B65H 1/266* (2013.01); *B65H 3/0684* (2013.01);
(Continued)

(58) Field of Classification Search
CPC ..... B65H 1/14; B65H 1/266; B65H 3/0684; B65H 7/02; B65H 7/04; B65H 7/20;
(Continued)

(56) References Cited

U.S. PATENT DOCUMENTS 5,897,112 A * 4/1999 Kwag ..... G03G 15/6502 271/111
6,227,732 B1 * 5/2001 Higuchi ..... B41J 13/0081 206/449

(Continued)

FOREIGN PATENT DOCUMENTS

JP 2002-255396 9/2002
JP 2010-173750 8/2010

OTHER PUBLICATIONS

Chinese Office Action, Oct. 8, 2016, Chinese Patent Application No. 201510494302.3 (6 pages).

*Primary Examiner* — Prasad Gokhale
(74) *Attorney, Agent, or Firm* — Hamre, Schumann, Mueller & Larson, P.C.

(57) ABSTRACT

A sheet feed device includes a removal sheet feed tray, a bottom plate provided in the sheet feed tray, and can be lifted up together with one or more papers stacked thereon so as to make an uppermost paper positioned at an upper limit position, a sheet feeder that feeds out the papers stacked on the bottom plate sequentially from the sheet feed tray, a sheet detection member that detects whether or not at least one paper is stacked on the sheet feed tray, an upper limit detection member that detects whether or not the uppermost paper is positioned at the upper limit position, and an evacuator that evacuates the sheet detection member and the upper limit detection member to an evacuation position where the sheet detection member and the upper limit detection member never interfere a removal and an installation of the sheet feed tray.

1 Claim, 10 Drawing Sheets

(51) Int. Cl.

| | |
|---|---|
| ***B65H 1/14*** | (2006.01) |
| ***B65H 1/26*** | (2006.01) |
| ***B65H 3/06*** | (2006.01) |
| ***B65H 7/04*** | (2006.01) |

(52) U.S. Cl.
CPC ..... *B65H 7/04* (2013.01); *B65H 2403/41* (2013.01); *B65H 2403/5332* (2013.01); *B65H 2403/541* (2013.01); *B65H 2553/612* (2013.01)

(58) Field of Classification Search
CPC ..... B65H 2403/41; B65H 2403/5332; B65H 2403/541; B65H 2553/612
See application file for complete search history.

(56) References Cited

U.S. PATENT DOCUMENTS

| | | | | |
|---|---|---|---|---|
| 2009/0066006 | A1* | 3/2009 | Lee | B65H 7/04 271/8.1 |
| 2011/0140346 | A1* | 6/2011 | Fujita | B65H 43/00 271/110 |
| 2013/0222505 | A1* | 8/2013 | Akatsuka | B41J 11/0095 347/110 |
| 2014/0203496 | A1* | 7/2014 | Hamasaki | B65H 7/06 271/18 |

* cited by examiner

SHEET FEED DEVICE

BACKGROUND OF THE INVENTION

Technical Field

The present invention relates to a sheet feed device including a detachable sheet feed tray.

Background Arts

Generally, an image forming apparatus for printing images or texts on print sheets (papers), a copy machine for copying images or texts on copier sheets (papers), a sheet processing machine for operating various processes to sheets (papers) and so on are provided with a sheet feed device for feeding sheets (papers).

For example, a Patent Document 1 (Japanese Patent Application Publication No. 2010-173750: this application was filed by the preset applicant) discloses a sheet feed feeder. The sheet feed device disclosed in the Patent Document 1 (whose drawings are not shown in this application) is disposed at a lower portion of a main body of an image forming apparatus, and includes plural detachable sheet feed trays. The sheet feed device supplies sheets to an image forming unit of the image forming apparatus.

In the above-mentioned sheet feed device, three detachable sheet feed trays are disposed vertically at a front lower portion of a main body of the sheet feed device so as to cope with different paper sizes. Each of the sheet feed trays can be drawn out from the main body to the front side. With respect to each of the sheet feed trays, an uppermost sheet is selectively fed forward among plural sheets stacked on each of the sheet feed trays.

A following explanation will be made by taking one of the sheet feed trays in the above-mentioned sheet feed device as an example. A detachable sheet feed tray detachably installed in the main body of the sheet feed device has a height that enables to accommodate 500 sheets of plain papers (normal papers) that is one package unit. A bottom plate is provided at a lower portion of the sheet feed tray via a lifter plate (movable plate) so as to be moved up and down by the lifter plate, and plural papers all having an identical size are stacked on the bottom plate.

When the sheet feed tray is installed in the main body, the lifter plate is lifted up by its drive source, and thereby a leading-side portion (in a sheet feed direction) of the uppermost sheet of the stacked papers is moved upward to au upper limit position so as to face to an after-described sheet feeder. The upper limit position is preliminarily set at an almost constant height level according to a height of the sheet feed tray regardless of the number of papers stacked on the bottom plate.

A sheet feed mechanism is provided above the sheet feed tray in the main body, and a base of the sheet feed mechanism extends longitudinally along an insertion direction of the sheet feed tray into the main body. The sheet feed mechanism also includes a scraper roller and a pickup roller (sheet feed roller). The scraper roller and the pickup roller serve as the above-mentioned sheet feeder, and are disposed at the center of the base along a longitudinal direction of the base. The scraper roller and the pickup roller are aligned from upstream to downstream along the sheet feed direction in this order.

The scraper roller on the upstream side is supported swingably via swing arms that are pivotally attached to a rotational shaft of the pickup roller on the downstream side. The scraper roller is driven by a rotational force of the pickup roller via a transfer gear set The scraper roller swingably supported by the swing arms will be evacuated to an upper position so as not to contact with the sheet feed tray when the sheet feed tray is draw out from the main body of the sheet feed device and when the sheet feed tray is inserted into the main body of the sheet feed device. However, the installation of the sheet feed tray in the main body is completed, (leading-side portions of stacked papers are moved upward and) the scraper roller is moved downward, and thereby the scraper roller is contacted with the uppermost paper of the stacked papers.

The pickup roller on the downstream side is connected with its rotational drive source, and faces to a handling unit disposed beneath the pickup roller. Even when the rotating scraper roller draws plural papers from the sheet feed tray, the pickup roller and the handling unit feed (handle) only the uppermost paper to the image forming unit disposed on a downstream side therefrom.

A sheet detector is also provided on the base near the scraper roller and the pickup roller, the sheet detector includes a swingably-movable sheet detection wheel. The sheet detector detects whether or not a paper is remained on the bottom plate of the sheet feed tray. In addition, an upper limit detector is further provided on the base near the scraper roller and the pickup roller, and the upper limit detector also includes a swingably-movable upper limit detection wheel. The upper limit detector detects whether or not the leading-side portion of the uppermost paper is positioned at the upper limit position.

The sheet detection wheel and the upper limit detection wheel are attached to the base so as not to contact with the sheet feed tray when the sheet feed tray is draw out from the main body of the sheet feed device and when the sheet feed tray is inserted into the main body of the sheet feed device. Further, a position adjuster is also provided on the base, and the position adjuster adjusts a position of the upper limit detector. The position adjuster is provided with an operative portion disposed on a front side of the main body of the sheet feed device (the image forming apparatus).

According to the sheet feed device disclosed in the Patent Document 1, the position of the upper limit detector can be adjusted by the position adjuster from the front side of the main body without drawing out the sheet feed tray from the main body, so that an operator can adjust the position of the upper limit detector accurately while watching a positional relation between the upper limit detector and the sheet feed tray. In addition, the operator can also adjust the position of the upper limit detector easily.

SUMMARY OF THE INVENTION

However, in the sheet feed device disclosed in the Patent Document 1, the detachable sheet feed tray can accommodates 500 sheets of plain papers (normal papers) that is one package unit on the bottom plate as described above. A height of 500 sheets of normal papers (one package unit) may be almost 45 mm, so that a height of the sheet feed tray is set to almost 50 mm so as to accept the height of 45 mm Here, various types of sheets (papers), e.g. thin papers, normal papers and thick papers can be set on the bottom plate. There is a demand for setting 500 sheets of thick papers in the sheet feed tray. Of course, a thick paper is thicker than a normal paper.

In addition, a thickness (paper density) of a copier paper (plain paper) in Japan is different from that in other countries. A thickness (paper density) of a copier paper is 67 to 70 g/m$^2$ in Japan, but it may be almost 80 to 90 g/m$^2$ in other countries. There is also a demand for setting 500 sheets of copier papers (one package unit) of other countries in the sheet feed tray.

In order to fulfill the above demands, a height of the sheet feed tray should be redesigned to have a 58 mm height that is 8 mm higher than the 50 mm height of the prior sheet feed tray, because a height of 500 sheets of thick papers or normal papers of other countries increases by almost 8 mm compared with normal papers in Japan.

If a height of the sheet feed tray is changed in order to accommodate 500 sheets of thick papers or normal papers of other countries, the 8 mm higher height of the sheet feed tray will bring no problem to the scraper roller. This is because the scraper roller swingably supported on the base by the swing arms will be evacuated to an upper position so as not to contact with the sheet feed tray when the sheet feed tray is draw out from the main body of the sheet feed device and when the sheet feed tray is inserted into the main body of the sheet feed device.

On the other hand, if a height of the sheet feed tray is changed in order to accommodate 500 sheets of thick papers or normal papers of other countries, the 8 mm higher height of the sheet feed tray will bring a problem to the sheet detection wheel and the upper limit detection wheel. This is because the sheet detection wheel and the upper limit detection wheel will not be evacuated in drawing out the sheet feed tray from the main body of the sheet feed device and in inserting (installing) the sheet feed tray into the main body of the sheet feed device. The sheet detection wheel and the upper limit detection wheel are only designed so as not to contact with the prior 50 mm-height sheet feed tray, so that they will contact with the redesigned higher sheet feed tray when drawing-out and inserting of the redesigned higher sheet feed tray and will be damaged.

An object of the present invention is to provide a sheet feed device that can prevent a sheet feed tray from contacting with a sheet detection member (sheet detection wheel) and an upper limit detection member (upper limit detection wheel) in drawing out the sheet feed tray from the sheet feed device and in inserting the sheet feed tray into the sheet feed device, even when a height of sheets stacked on the sheet feed tray is made higher.

An aspect of the present invention provides A sheet feed device comprising: a removal sheet feed tray that is installed in the sheet feed device; a bottom plate that is provided in the sheet feed tray, and is capable of being lifted up together with one or more papers stacked thereon so as to make a leading portion of an uppermost paper positioned at an upper limit position when the sheet feed tray is installed in the sheet feed device; a base that is provided within the sheet feed device, and to which a sheet feeder, a sheet detection member and an upper limit detection member are attached; the sheet feeder that feeds out the papers stacked on the bottom plate sequentially from the sheet feed tray; the sheet detection member that detects whether or not at least one paper is stacked on the sheet feed tray by a contact detection with the paper or the bottom plate; the upper limit detection member that detects whether or not the leading portion of the uppermost paper is positioned at the upper limit position by a contact detection with the uppermost paper; and an evacuator that evacuates the sheet detection member and the upper limit detection member to an evacuation position where the sheet detection member and the upper limit detection member never interfere a removal of the sheet feed tray from the sheet feed device and an installation of the sheet feed tray in the sheet feed device.

The sheet feed device according to the aspect includes the evacuator that evacuates the sheet detection member and the upper limit detection member. Therefore, a height of the papers tacked on the sheet feed tray (the bottom) or a height of the sheet feed tray itself can be made higher. Even when the height is made higher, it is possible to prevent the sheet detection member and the upper limit detection member from contacting the stacked paper or the sheet feed tray. As the result, reliability and durability of the sheet feed device can be improved.

It is preferable that the sheet detection member is swingably attached to the base by a first swingable lever so as to be swung downward due to its own weight, the upper limit detection member is swingably attached to the base by a second swingable lever so as to be swung downward due to its own weight, the second swingable lever is capable of being coupled with the first swingable lever so as to be freely contactable with each other and freely separable from each other, and the upper limit detection member is evacuated to the evacuation position simultaneously and interrelatedly to an evacuation of the sheet detection member to the evacuation position by coupling of the second swingable lever with the first swingable lever.

According to this configuration, the evacuations of the sheet detection member and the upper limit detection member are done simultaneously and interrelatedly to each other by coupling of the second swingable lever with the first swingable lever. Therefore, the evacuator can be used partially in common by both of the sheet detection member and the upper limit detection member. In addition, the configuration of the evacuator can be made simpler.

DESCRIPTION OF THE EMBODIMENT

Hereinafter, a sheet feed device according to an embodiment will be described with reference to the drawings.

Figure 1:
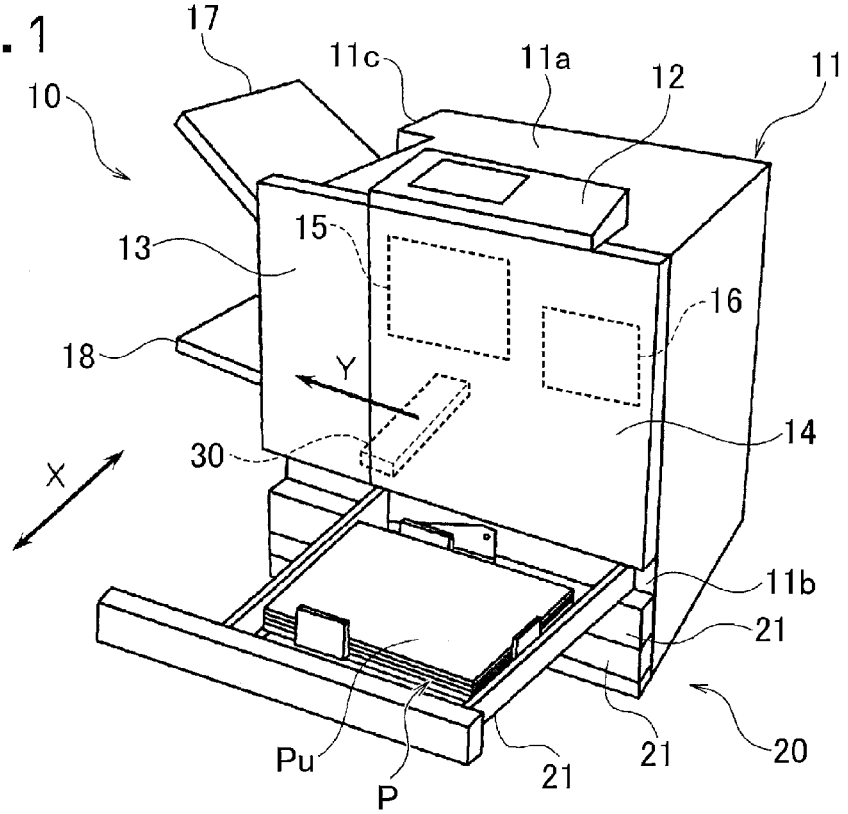
FIG. 1 is a perspective view of an image forming apparatus equipped with a sheet feed device according to an embodiment.

As shown in FIG. 1, the sheet feed device 20 in the present embodiment is integrated with an image forming apparatus (e.g. a printer) 10 that prints images or texts on print sheets (papers). However, the sheet feed device 20 may be integrated with (installed in) a copy machine that copies images or texts on copier sheets (papers), a sheet processing machine that operates various processes to sheets (papers), and so on.

The sheet feed device 20 is disposed at a lower portion of the image forming apparatus 10. A main body 11 is formed to have a box shape, and configures an appearance of the image forming apparatus 10 and the sheet feed device 20. In the image forming apparatus 10, an operation panel 12 is provided on a top panel 11*a* of the main body 11. Doors 13 and 14 are provided on left and right outer sides of a front panel 11*b* of the main body 11. The front panel 11*b* is provided on a front side of the main body 11. The sheet feed device 20 is disposed beneath the doors 13 and 14.

The sheet feed device 20 includes three sheet feed trays 21 that are aligned vertically. The sheet feed trays 21 are detachable, i.e. can be drawn out from the sheet feed device 20 and can be inserted (installed) into the sheet feed device 20 in a direction X shown in FIG. 1. Papers are stacked on the sheet feed trays 21, and the sheet feed trays 21 accommodate papers with respect to different paper sizes.

Figure 2:
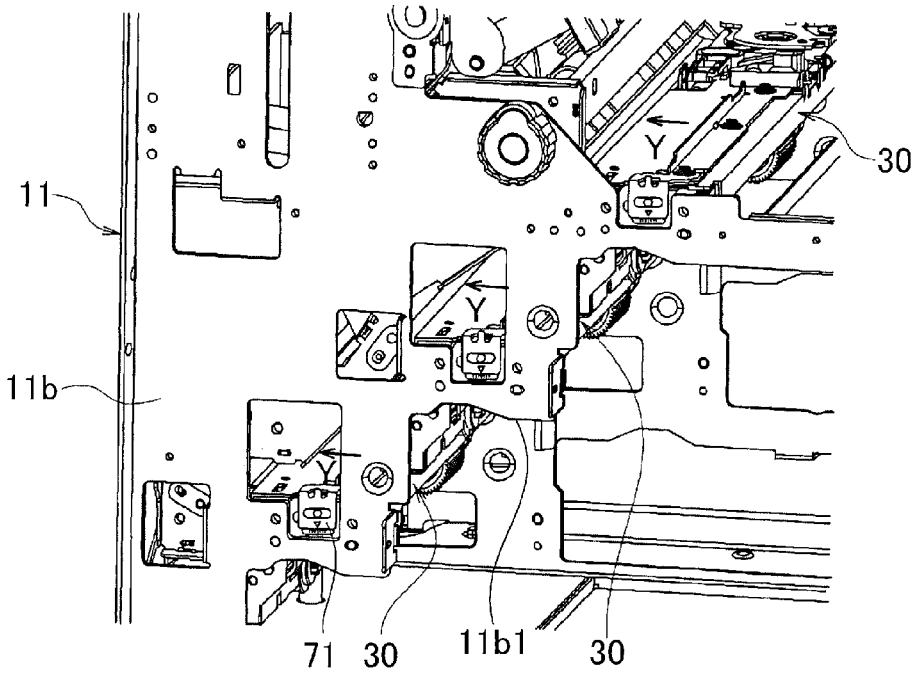
FIG. 2 is an enlarged perspective view showing plural sheet feed mechanisms of the sheet feed device disposed at a lower portion of the image forming apparatus.

As shown in FIG. 2, three sheet feed mechanism 30 are aligned in a stepped manner on a left inner side of the front panel 11*b* of the main body 11 so as to be associated with the three sheet feed trays 21. Each of the sheet feed mechanisms 30 can be seen through a tray detaching opening 11*b*1 that can be accessed when the front panel 11*b* is widely opened. Therefore, the sheet feed device 20 is provided with three pairs of the sheet feed tray 21 and the sheet feed mechanism 30.

The sheet feed mechanism(s) 30 is disposed on a leading side of an uppermost paper Pu among papers stacked on the sheet feed tray(s) 21 along a sheet feed direction Y shown in FIG. 1 so as to face to the uppermost paper Pu. The uppermost paper Pu among papers stacked on the sheet feed tray(s) 21 can be fed forward in the sheet feed direction Y by the sheet feed mechanism(s) 30.

An image forming unit 15 and a controller 16 are disposed on an inner side of the doors 13 and 14. The image forming unit 15 forms images or texts on a paper, e.g. in an inkjet method. The controller 16 controls the image forming apparatus 10 and the sheet feed device 20 comprehensively. An sheet ejection tray 17 and a manual feed tray 18 are provided vertically so as to be separated from each other on a side of a left side plate 11*c* of the main body 11. Papers on which images or texts have been formed are ejected onto the sheet ejection tray 17, and then stacked on the sheet ejection tray 17. Papers can be fed (supplied) manually from the manual feed tray 18.

One pair of the sheet feed tray 21 and the sheet feed mechanism 30 will be taken as an example, and the one pair will be described hereinafter in order to describe configuration of the sheet feed device 20.

Figure 3:
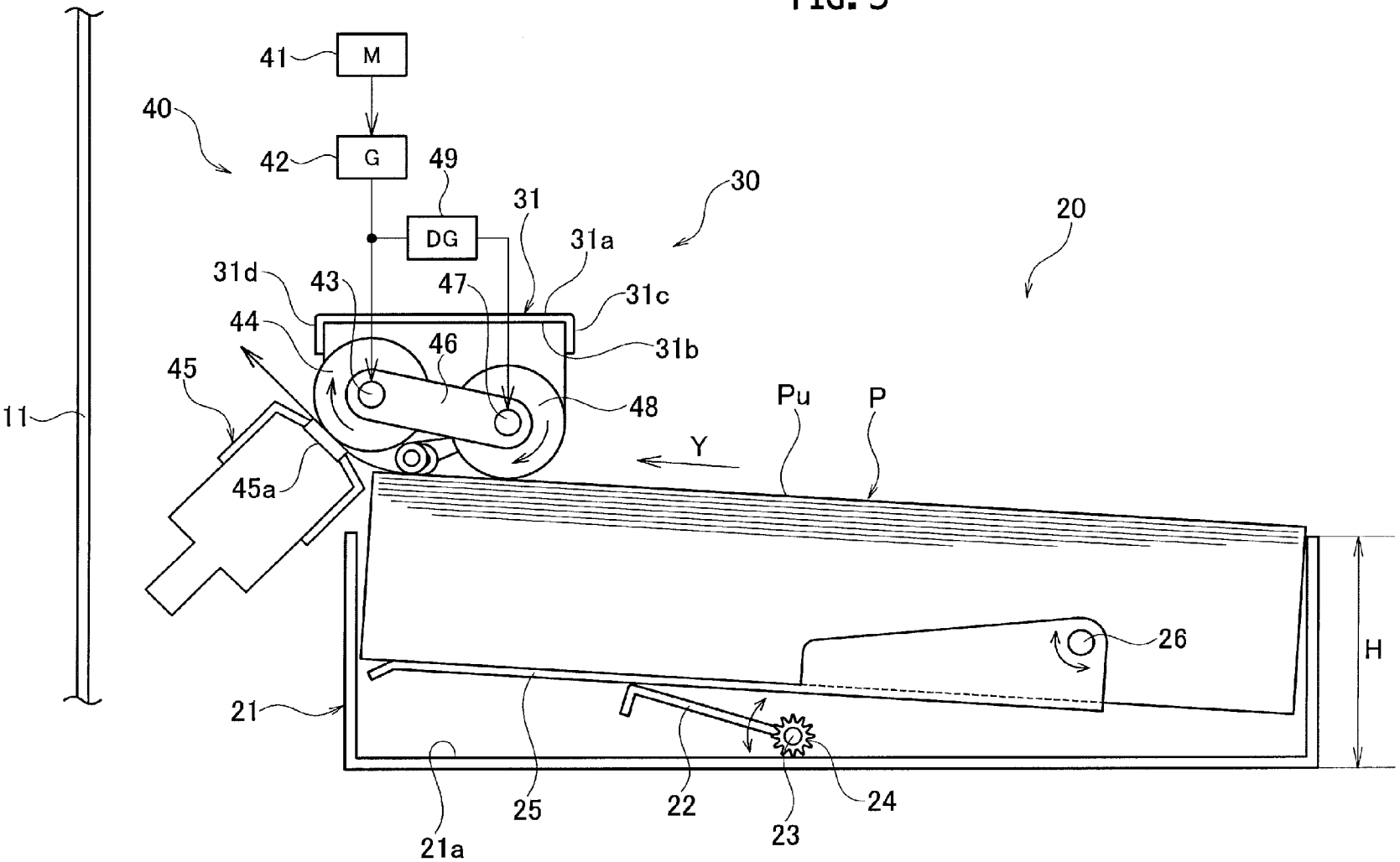
FIG. 3 is a schematic side view of the sheet feed mechanism in the sheet feed device.

As shown in FIG. 3, the sheet feed tray 21 is formed to have a cuboid shape whose upper face is opened in order to set papers from above. A lifter plate 22 is provided on a bottom surface 21*a* of the sheet feed tray 21 so as to be swingable integrally with a first rotational shaft 23 about the first rotational shaft 23. When the sheet feed tray 21 is installed in the sheet feed device 20 (the main body 11), a gear 24 attached to the first rotational shaft 23 is meshed with a reduction gear set that transmits a drive force of a motor (not shown in the drawings) provided in the main body 11, and then the lifter plate 22 can be lifted up by the drive force.

A bottom plate 25 on which papers P are stacked is provided in the sheet feed tray 21 swingably about a second rotational shaft 26. An end portion (a leading-side portion in the sheet feed direction Y) of the bottom plate 25 can be lifted up by the lifter plate 22 that contacts with a bottom surface of the bottom plate 25. A height H of the sheet feed tray 21 is made 8 mm higher than a height of a prior sheet feed tray so that 500 sheets of 500 sheets of thick papers or normal papers of other countries (one package unit) can beset in the sheet feed tray 21.

When the sheet feed tray 21 is installed in the sheet feed device 20 (the main body 11), the bottom plate 25 is lifted up by the lifter plate 22 so that a leading-side portion of the uppermost paper Pu among papers P stacked on the bottom plate 25 is located at an upper limit position predetermined according to the height H of the sheet feed tray 21. Detection of the upper limit position will be described later. The sheet feed mechanism 30 is located above the leading-side portion of the uppermost paper Pu among papers P stacked on the bottom plate 25.

Figure 4:
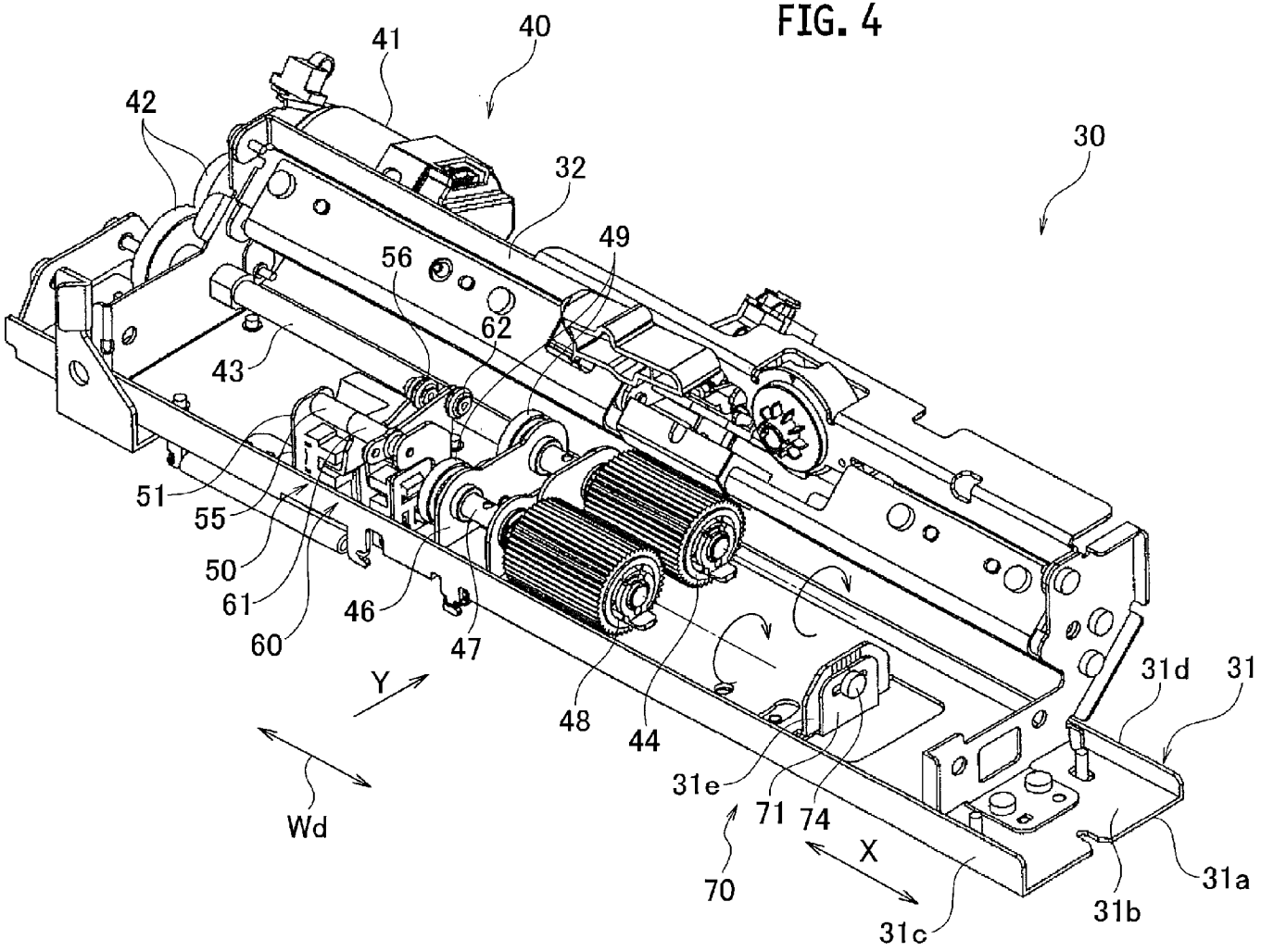
FIG. 4 is a perspective view of the sheet feed mechanism when viewed from its bottom side.
Figure 7:
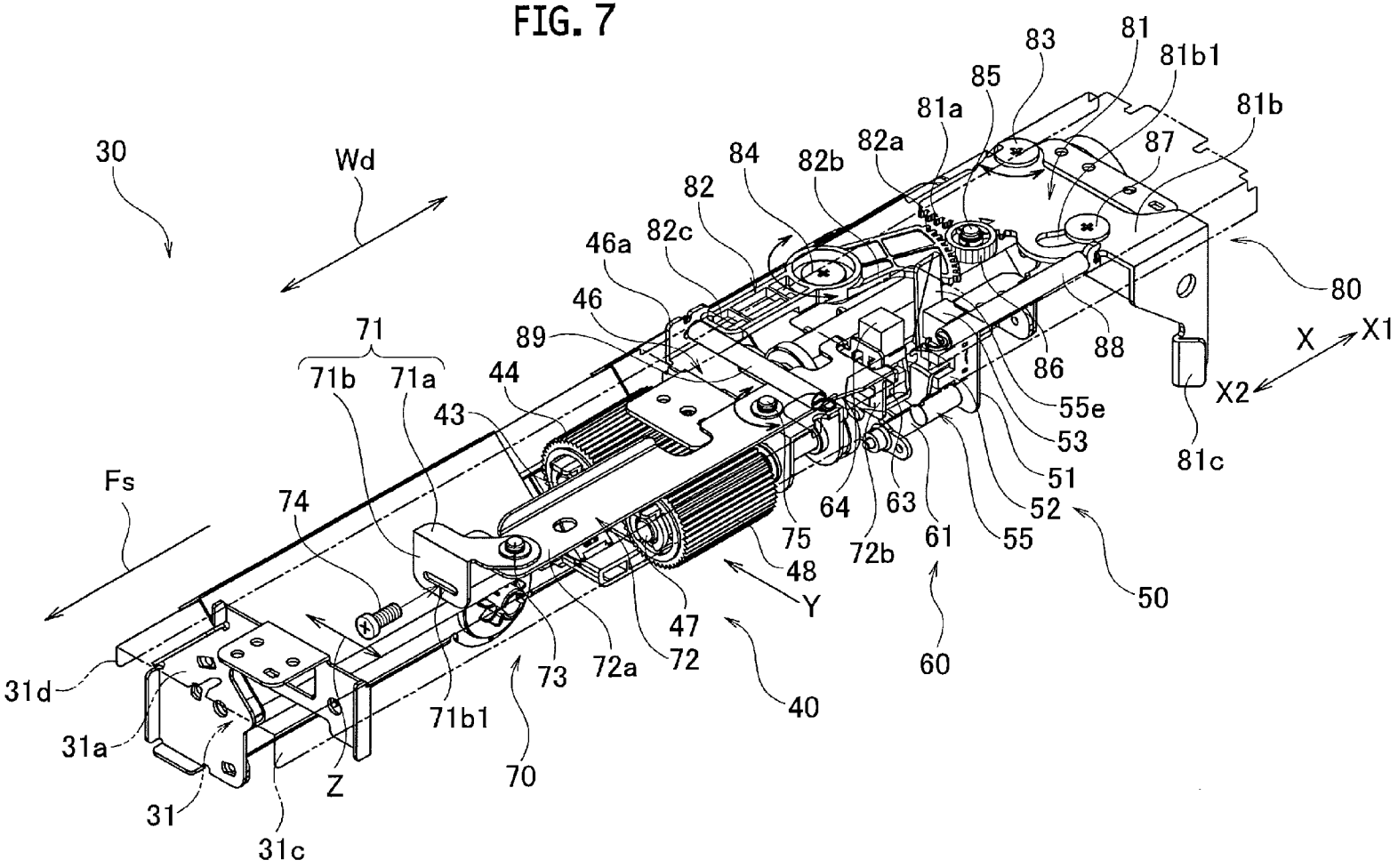
FIG. 7 is a perspective view of the sheet feed mechanism when viewed from its upper side.

As shown in FIG. 3, FIG. 4 and FIG. 7, the sheet feed mechanism 30 includes a base 31, a sheet feeder 40, a sheet detector 50, an upper limit detector 60, an upper limit adjuster 70, and an evacuator 80. The evacuator 80 evacuates a scraper roller 48, a sheet detection wheel 56 that serve as a sheet detection member, and an upper limit detection wheel 62 that serves as an upper limit detection member to an upper position (evacuation position). The sheet feeder 40, the sheet detector 50, the upper limit detector 60, the upper limit adjuster 70, and the evacuator 80 are assembled on the base 31, and will be described hereinafter one by one.

As shown in FIG. 3 and FIG. 4, the base 31 is formed longitudinally along its longitudinal direction (the sheet width direction Wd) perpendicular to the sheet feed direction Y. An upper surface 31*a* and a lower surface 31*b* of the base 31 are formed flat, and both edge of the base 31 along the longitudinal direction (sheet width direction Wd) are formed as side flanges 31*c* and 31*d* that face to each other. The side flange 31*c* is located on an upstream side and the side flange 31*d* is located on a downstream side along the sheet feed direction Y. Namely, the side flanges 31*c* and 31*d* extend along the sheet width direction Wd. The base 31 assembled with the sheet feeder 40, the sheet detector 50, the upper limit detector 60, the upper limit adjuster 70, and the evacuator 80 is installed on an inner side of the front panel 11*b* of the main body 11 as shown in FIG. 2.

A bracket 32 (shown only in FIG. 4) is attached to the lower surface 31*b* of the base 31 along the longitudinal direction (sheet width direction Wd). A motor 41 that serves as a drive source of the sheet feeder 40 is attached to the bracket 32, and a first rotational shaft 43 is also attached to the bracket 32 so as to extend along the sheet width direction Wd perpendicular to the sheet feed direction Y. A drive force of the motor 41 is transmitted to the first rotational shaft 43 via a reduction gear set 42.

When the leading-side portion of the uppermost paper Pu among papers P stacked on the bottom plate 25 is located at the upper limit position, the sheet feeder 40 feeds (supplies) the uppermost paper Pu to the image forming unit 15 shown in FIG. 1 sheet by sheet. In the sheet feeder 40, a sheet feed roller 44 is fixed with the first rotational shaft 43 provided along the sheet width direction Wd almost parallel to the side flange 31*d* formed on the downstream side of the base 31 along the sheet feed direction Y. The sheet feed roller 44 is located at almost the center along the sheet width direction Wd. Therefore, the sheet feed roller 44 rotates integrally with the first rotational shaft 43. Note that the sheet feed roller 44 corresponds to the pickup roller described in the above "Background Arts" section.

A handling unit 45 (shown only in FIG. 3) is provided beneath the sheet feed roller 44 so as to face to the sheet feed roller 44. The sheet feed roller 44 contacts with a sheet handling pad 45*a* of the handling unit 45. One end of a swing arm 46 is swingably supported by the first rotational shaft 43, and another end of the swing arm 46 is extended to an upstream side from the sheet feed roller 44 along the sheet feed direction Y. A second rotational shaft 47 is supported by the other end of the swing arm 46 so as to be almost parallel to the first rotational shaft 43 and the side flange 31*c*. A scraper roller 48 is fixed on the second rotational shaft 47, and the scraper roller 48 is also located at almost the center along the sheet width direction Wd similarly to the sheet feed roller 44.

A transfer gear set 49 is provided between the first rotational shaft 43 and the second rotational shaft 47. Rotations of the first rotational shaft 43 is transferred to the second rotational shaft 47 via the transfer gear set 49, so that the scraper roller 48 is rotated integrally with the second rotational shaft 47 in a direction indicated by an arrow shown in FIG. 3 or FIG. 4.

Even when the scraper roller 48 located on an upstream side draws plural papers P from the sheet feed tray 21, the sheet feed roller 44 and the handling unit 45 (sheet handling pad 45*a*) located on a downstream side feed (handle) only the uppermost paper Pu to downstream in the sheet feed direction Y.

Figure 5:
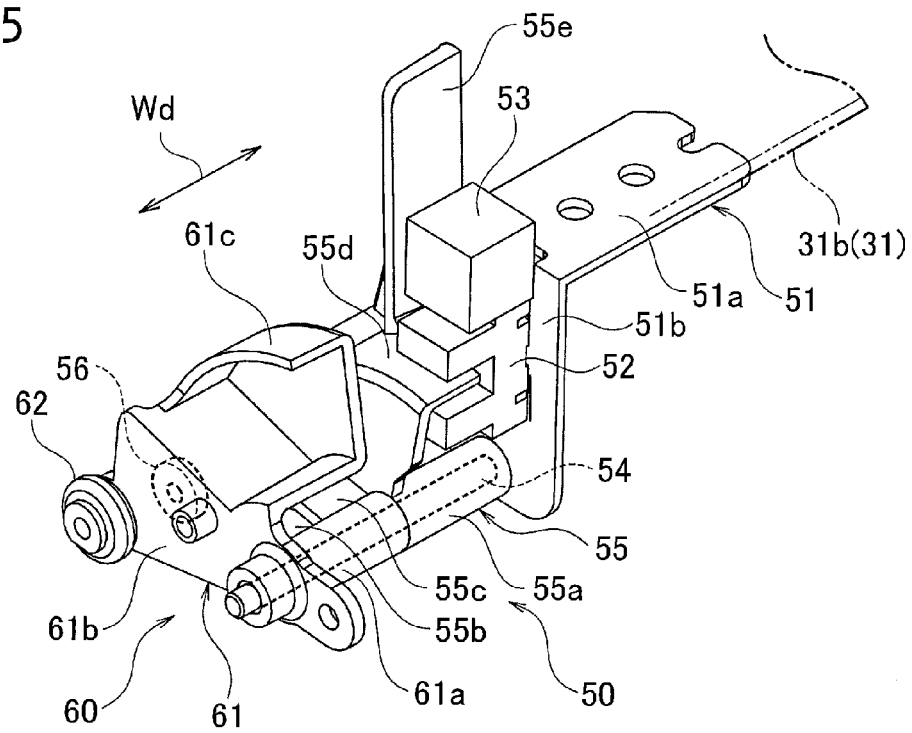
FIG. 5 is a perspective view showing a sheet detector and an upper limit detector that are provided in the sheet feed mechanism.

As shown in FIG. 4 and FIG. 5, the sheet detector 50 and the upper limit detector 60 are provided side by side on the lower surface 31*b* near the sheet feed roller 44 and the scraper roller 48. The sheet detector 50 detects whether or not a paper(s) P is remained on the bottom plate 25 that can be lifted up in the sheet feed tray 21.

An upper surface 51*a* of an L-shaped bracket 51 of the sheet detector 50 is attached to the lower surface 31*b* of the base 31. A sheet detection optical sensor 52 and a connector 53 are attached to a left-side surface 51*b* of the L-shaped bracket 51. A shaft 54 is laterally provided beneath the sheet detection optical sensor 52 so as to extend along the sheet width direction Wd. A first swingable lever 55 of the sheet detector 50 is axially supported by the shaft 54, and disposed on a base-end side of the shaft 54. The first swingable lever 55 includes the sheet detection wheel 56, and is swingable downward due to its own weight and a weight of the sheet detection wheel 56.

The first swingable lever 55 includes a shaft sleeve 55*a*, a left-side plate 55*b*, a stepped coupling plate 55*c*, a shield plate 55*d*, and a protruded tab 55*e*. The shaft sleeve 55*a*, the left-side plate 55*b*, the stepped coupling plate 55*c*, the shield plate 55*d*, and the protruded tab 55*e* are integrally molded to form the first swingable lever 55. The shaft 54 is inserted into the shaft sleeve 55*a*. The left-side plate 55*b* is extended leftward from the shaft sleeve 55*a*. The stepped coupling plate 55*c* is continued upward from the shaft sleeve 55*a* and the left-side plate 55*b*, and can be coupled with a second swingable lever 61 so as to be freely contactable with each other and freely separable from each other. The shield plate 55*d* is continued from the stepped coupling plate 55*c*, and has a curved surface that is curved according to a swing trajectory. The protruded tab 55*e* is protruded upward from the shield plate 55*d*.

The first swingable lever 55 axially supports the cylindrical sheet detection wheel 56 (that serves as one example of the sheet detection member) at its lower end of the left-side plate 55*b* on an opposite side to the shaft 54. The first swingable lever 55 can swing downward about the shaft 54 due to its own weight and a weight of the sheet detection wheel 56 so as to contact with the uppermost paper Pu among papers P stacked on the bottom plate 25 that can be lifted up in the sheet feed tray 21.

Figure 6A:
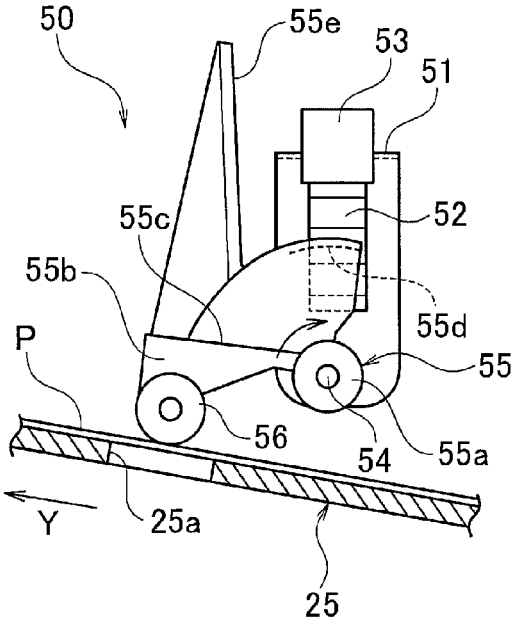
FIG. 6A is a side view of the sheet detector when a paper(s) is remained on a bottom plate of the sheet feed tray.

If a paper(s) P is remained on the bottom plate 25 as shown in FIG. 6A, a through hole 25*a* formed on a leading-side portion (in the sheet feed direction Y) of the bottom plate 25 is closed by the paper(s) P. In this state, the sheet detection wheel 56 of the sheet detector 50 axially supported at the left-side plate 55*b* contacts with the paper(s) P. Therefore, the sheet detection optical sensor 52 detects the shield plate 55*d*, and thereby the controller 16 shown in FIG. 1 determines that a paper(s) P is remained on the bottom plate 25 based on an output signal from the sheet detection optical sensor 52. Namely, "paper existence" is detected.

Figure 6B:
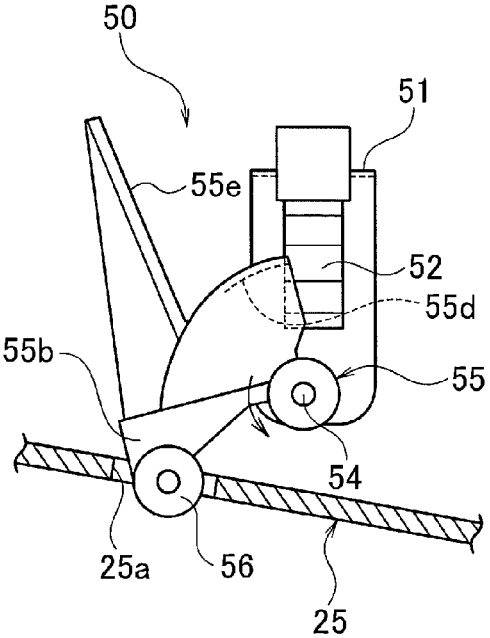
FIG. 6B is a side view of the sheet detector when no paper is remained on the bottom plate of the sheet feed tray.

On the other hand, if no paper P is remained on the bottom plate 25 as shown in FIG. 6B, the first swingable lever 55 further swings counter-clockwise due to its own weight and a weight of the sheet detection wheel 56, and the sheet detection wheel 56 falls into the through hole 25*a* that is not closed by a paper(s) P. Therefore, the sheet detection optical sensor 52 doesn't detect the shield plate 55*d*, and thereby the controller 16 shown in FIG. 1 determines that no paper P is remained on the bottom plate 25 based on an output signal from the sheet detection optical sensor 52. Namely, "paper empty" is detected. Note that a function of the protruded tab 55*e* *will be described later.*

As shown in FIG. 5, the upper limit detector 60 is disposed on a left side of the sheet detector 50. The upper limit detector 60 detects whether or not a leading-side portion of the uppermost paper Pu (among papers P that are stacked on the bottom plate 25 and whose leading-side portions are moved upward in the sheet feed tray 21) is positioned at the upper limit position. The second swingable lever 61 of the upper limit detector 60 is axially supported by the shaft 54 that axially supports also the first swingable lever 55, and disposed on an open-end side of the shaft 54. Namely, the shaft 54 is used in common by both of the first swingable lever 55 and the second swingable lever 61. The second swingable lever 61 includes the upper limit detection wheel 62, and is swingable downward due to its own weight and a weight of the upper limit detection wheel 62.

The second swingable lever 61 includes a shaft sleeve 61*a*, a left-side plate 61*b*, and a shield plate 61*c*. The shaft sleeve 61*a*, the left-side plate 61*b*, and the shield plate 61*c* are integrally molded to form the second swingable lever 61. The shaft 54 is inserted into the shaft sleeve 61*a*. The left-side plate 61*b* is extended to leftward from the shaft sleeve 61*a*. The shield plate 61*c* is continued upward from the left-side plate 61*b*, and has a curved surface that is curved according to a swing trajectory. The shield plate 61*c* of the second swingable lever 61 is located over the stepped coupling plate 55*c*, and can be coupled with the stepped coupling plate 55*c* (the first swingable lever 55) so as to be freely contactable with each other and freely separable from each other.

The second swingable lever 61 axially supports the cylindrical upper limit detection wheel 62 (that serves as one example of the upper limit detection member) at its lower end of the left-side plate 61*b* on an opposite side to the shaft 54. The second swingable lever 61 can swing downward about the shaft 54 due to its own weight and a weight of the upper limit detection wheel 62 so as to contact with the uppermost paper Pu among papers P stacked on the bottom plate 25 that can be lifted up in the sheet feed tray 21. An upper limit detection optical sensor 63 and a connector 64 are attached to an end plate 72*b* of an adjusting lever 72 of the upper limit adjuster 70 (these will be described later with reference to FIG. 7)

When a leading-side portion of the uppermost paper Pu among papers P stacked on the bottom plate 25 reaches (lifted upward to) the upper limit position and the upper limit detection wheel 62 contacts with the leading-side portion of the uppermost paper Pu (this state is not shown in the drawings), the upper limit detection optical sensor 63 detects the shield plate 61*c*, and thereby the controller 16 shown in FIG. 1 determines that the leading-side portion of the uppermost paper Pu is located at the upper limit position based on an output signal from the upper limit detection optical sensor 63.

As shown in FIG. 7, a position of the upper limit detection optical sensor 63 of the upper limit detector 60 can be adjusted by the upper limit adjuster 70 in a case where it is desired to change the upper limit position. The upper limit adjuster 70 includes an operation lever 71 on the upper surface 31*a* of the base 31. The operation lever 71 is located on a front side of the sheet feed device 20 (the main body 11). The operation lever 71 is pivotally attached to a front-side end of a planar portion 72*a* of the adjusting lever 72 by a first pin 73. Therefore, when the operation lever 71 is slid in a direction Z shown in FIG. 7, the adjusting lever 72 is swung about a second pin 75. Note that, in order to provide better accessibility, the operation lever(s) 71 shown in FIG. 2 is located closer to the front panel 11*b* of the main body 11 than the operation lever 71 shown in FIG. 7.

The operation lever 71 has an upper panel 71*a* and an operation panel 71*b* extending downward from a left end of the upper panel 71*a*. The operation panel 71*b* faces to a tab 31*e* (shown only in FIG. 4) that is formed by bending a portion of the base 31 downward from the upper surface 31*a* to the lower surface 31*b*. A fixation screw 74 is inserted through an elongated hole 71*b*1, and is screwed in a screw hole formed on the tab 31*e*. Therefore, a slide position of the operation panel 71*b* relative to the tab 31*e* can be fixed by fastening the fixation screw 74. Note that scale marks are engraved on the operation panel 71*b* and the tab 31*e* as shown in FIG. 1 and FIG. 4 in order to gauge the slide position of the operation panel 71*b* relative to the tab 31*e*.

The adjusting lever 72 is formed longitudinally along the longitudinal direction of the base 31, and a center portion of the planar portion 72*a* is pivotally attached to the upper surface 31*a* of the base 31 by the second pin 75. The planar portion 72*a* extends rearward from the center of the sheet width direction Wd, and an end plate 72*b* is extended downward from a rear-side end of the planer portion 72*a*. The upper limit detection optical sensor 63 and the connector 64 of the above-described upper limit detector 60 are attached to this planer portion 72*a*.

Since the operation lever 71 is located on a front side of the main body 11, a user can easily loosen the fixation screw 74 from the front side of the main body 11 to slide the operation lever 71 in the direction Z. When the operation lever 71 is slid in the direction Z, the adjusting lever 72 pivotally coupled with the operation lever 71 is swung about the second pin 75. As a result, the upper limit detection optical sensor 63 attached to the end plate 72*b* of the adjusting lever 72 is also slid parallel to the direction Z. After the adjustment of the position of the upper limit detection optical sensor 63, the fixation screw is fastened to fix the position of the upper limit detection optical sensor 63. By adjusting the position of the upper limit detection optical sensor 63, the upper limit position where the upper limit detection optical sensor 63 detects the shield plate 61*c* of the second swingable lever 61 can be adjusted.

Note that, it is not required to adjust the upper limit position, the upper limit detection optical sensor 63 may be provided fixedly. In this case, the upper limit detection optical sensor 63 may be fixedly attached onto the lower surface 31*b* of the base 31 by an L-shaped bracket so as to detect the shield plate 61*c* of the second swingable lever 61.

As shown in FIG. 7, the evacuator 80 is a featured portion of the present embodiment, and is improved so as to adapt to the higher height H of the sheet feed tray 21 that enables the accommodation of 500 sheets of thick papers or normal papers of other countries (one package unit). The evacuator 80 evacuates the scraper roller 48 of the sheet feeder 40, the sheet detection wheel 56 of the sheet detector 50, and the upper limit detection wheel 62 of the upper limit detector 60 to an upper position (the evacuation position) where they never interfere drawing-out (a removal) of the sheet feed tray 21 from the sheet feed device 20 (the main body 11) and inserting (an installation) of the sheet feed tray 21 into the sheet feed device 20 (the main body 11).

A first evacuation lever 81 of the evacuator 80 is swingably attached to a rear-side portion of the base 31 by a first support axial pin 83 that is pivotally attached to the base 31 on a side of the side flange 31*d* on a downstream side along the sheet feed direction Y, so that the first evacuation lever 81 can swing about the first support axial pin 83. A second evacuation lever 82 is swingably attached to the base 31 at a position between the rear-side portion and the center of the base 31 by a second support axial pin 84 that is pivotally attached to the base 31 on a side of the side flange 31*d* on a downstream side along the sheet feed direction Y, so that the second evacuation lever 82 can swing about the second support axial pin 84.

A first gear 81*a* is formed on a front side of the first evacuation lever 81, and the second gear 82*a* is formed on a rear side of the second evacuation lever 82. The first gear 81*a* and the second gear 82*a* are faced to each other on the upper surface 31*a* of the base 31 so as to form a distance between them. A transfer gear 86 is rotatably attached to the base 31 by a third support axial pin 85 in the distance, and is meshed with first gear 81*a* and the second gear 82*a*. According to this configuration, the first evacuation lever 81 is swung when the sheet feed tray 21 is drawn out from the sheet feed device 20 (the main body 11) and when the sheet feed tray 21 is inserted into the sheet feed device 20 (the main body 11). This swing of the first evacuation lever 81 (described in detail later) is transferred to the second evacuation lever 82 via the transfer gear 86.

A swing range of the first evacuation lever 81 is restricted by inserting a stopper pin 87 fixedly attached to the base 31 into an elongate curved hole 81*b*1 formed on an upper plate 81*b* of the first evacuation lever 81. The upper plate 81*b* is bend downward at its upstream-side end along the sheet feed direction Y, and a pressed tab 81*c* is formed at its lower end. The pressed tab 81*c* is located on an outer side from the side flange 31*c* formed on an upstream side of the base 31 along the sheet feed direction Y, and is formed by being bent back in a insertion direction X1 of the sheet feed tray 21 into the sheet feed device 20 (the main body 11).

A first tension spring 88 is provided between the upper plate 81*b* of the first evacuation lever 81 and the side flange 31*c* of the base 31, so that the first evacuation lever 81 is pulled (swung) to a front side of the sheet feed device 20 (the main body 11) by the first tension spring 88 when the sheet feed tray 21 is not installed in the sheet feed device 20 (the main body 11). Namely, the first evacuation lever 81 is urged by the first tension spring 88 in a draw-out direction X2 of the sheet feed tray 21 from the sheet feed device 20 (the main body 11).

Figure 9A:
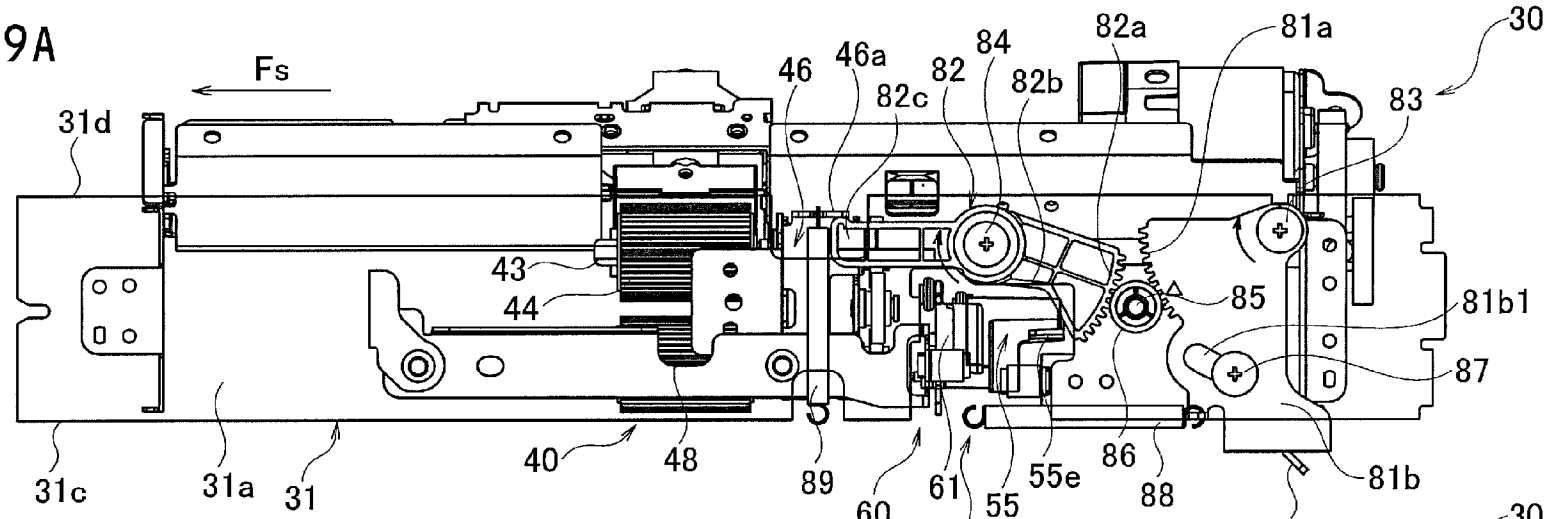
FIG. 9A is a plan view of the sheet feed mechanism when the sheet feed tray is not installed in the sheet feed device.
Figure 9B:
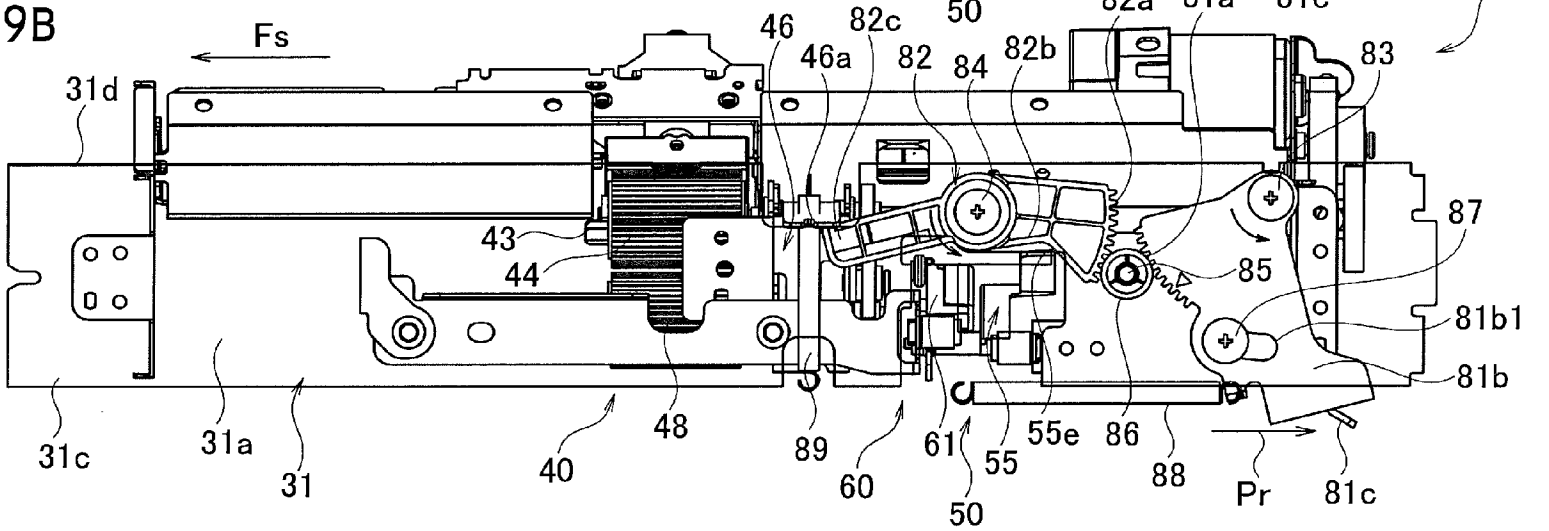
FIG. 9B is a plan view of the sheet feed mechanism when the sheet feed tray is installed in the sheet feed device.
Figure 10A:
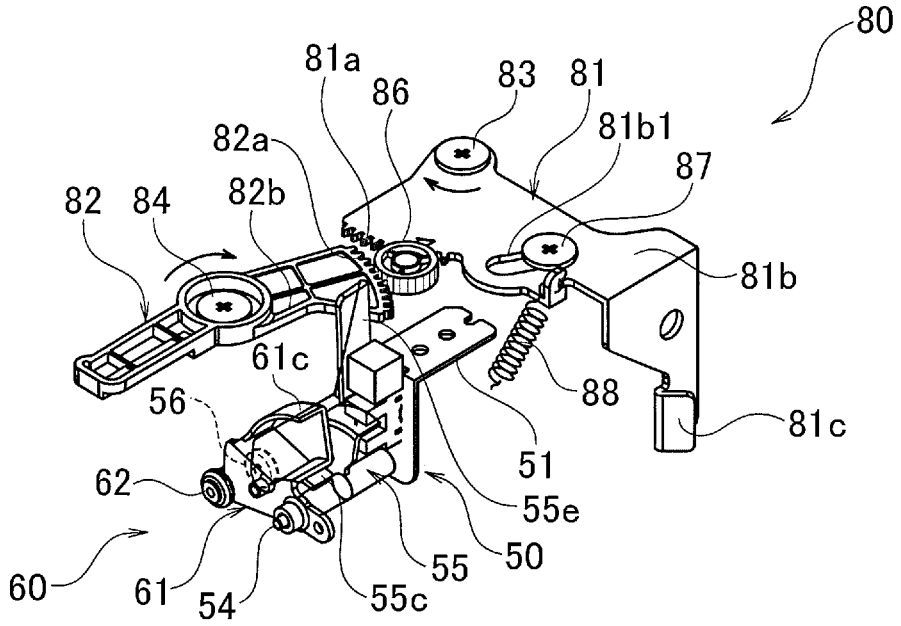
FIG. 10A is a perspective view of an evacuator of the sheet feed mechanism when the sheet feed tray is not installed in the sheet feed device.
Figure 10B:
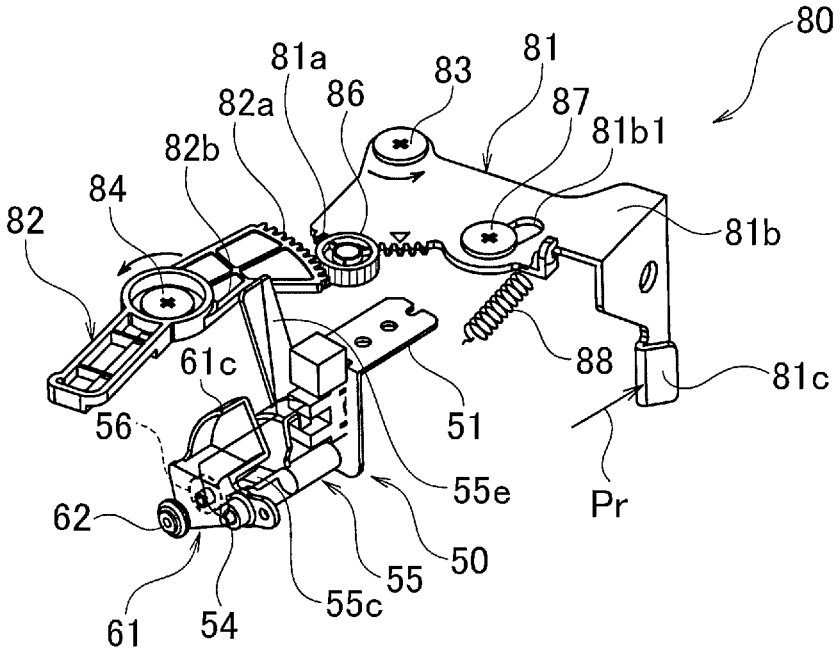
FIG. 10B is a perspective view of the evacuator of the sheet feed mechanism when the sheet feed tray is installed in the sheet feed device.
Figure 11A:
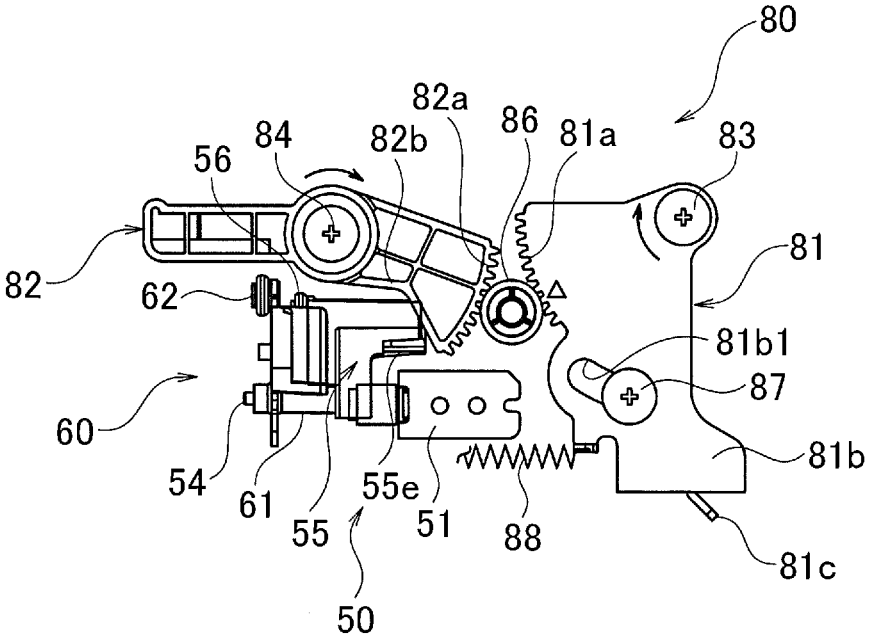
FIG. 11A is a plan view of the evacuator when the sheet feed tray is not installed in the sheet feed device.
Figure 11B:
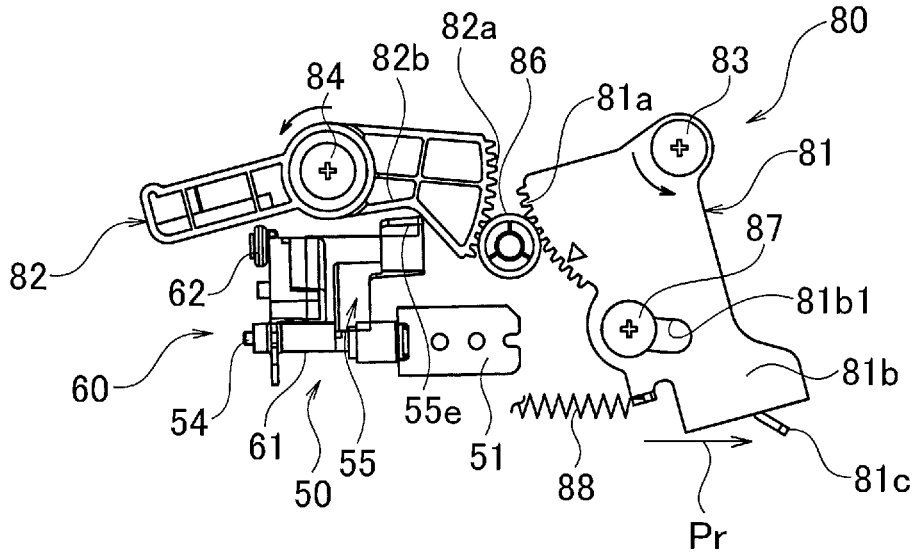
FIG. 11B is a plan view of the evacuator when the sheet feed tray is installed in the sheet feed device.
Figure 12A:
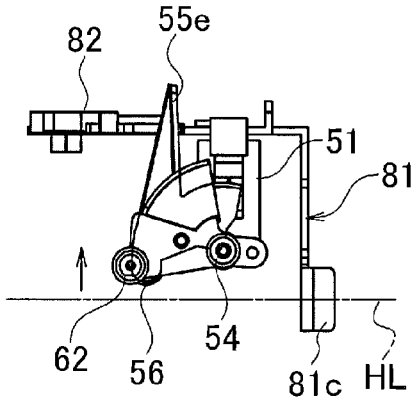
FIG. 12A is a side view of the evacuator when the sheet feed tray is not installed in the sheet feed device.
Figure 12B:
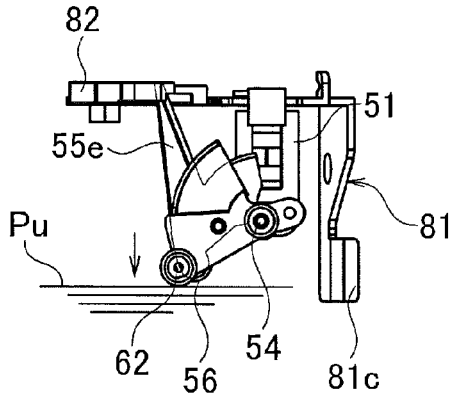
FIG. 12B is a side view of the evacuator when the sheet feed tray is installed in the sheet feed device.
Figure 13A:
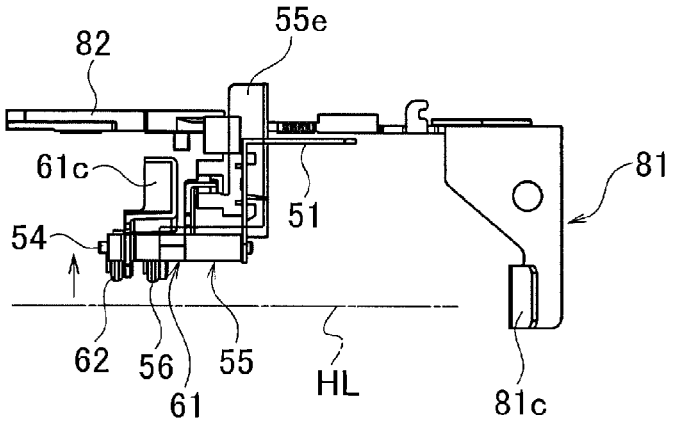
FIG. 13A is a front view of the evacuator when the sheet feed tray is not installed in the sheet feed device.
Figure 13B:
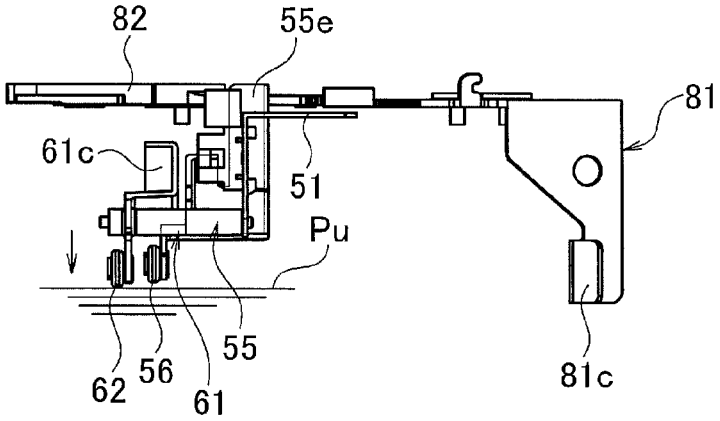
FIG. 13B is a front view of the evacuator when the sheet feed tray is installed in the sheet feed device.

On the other hand, the second evacuation lever 82 includes an angled portion 82*b* on its rear side from the second support axial pin 84 (see FIG. 9A and FIG. 9B). The angled portion 82*b* contacts with the protruded tab 55*e* of the first swingable lever 51 of the sheet detector 50 (see FIG. 10A and FIG. 10B). A contact position of the angled portion 82*b* with the protruded tab 55*e* changes within a certain contact range along the angled portion 82*b* according to a swing position of the second evacuation lever 82 (see FIG. 11A and FIG. 11B).

The second evacuation lever 82 also includes a front-side portion 82*c* on its front side from the second support axial pin 84 (see FIG. 7). The front-side portion 82*c* is extended to a front side of the main body 11 along the longitudinal direction of the base 31. An end of the front-side portion 82*c* contacts with an inner side of a protruded tab 46*a* protruded upward from the one end of the swing arm 46 that supports the scraper roller 48 of the sheet feeder 40. Since the one end of the swing arm 46 is swingably supported by the first rotational shaft 43 as described above, the protruded tab 46*a* of the swing arm 46 is formed so as to be located above the first rotational shaft 43 and to be protruded to a side of the side flange 31*c* of the base 31 on a downstream side along the sheet feed direction Y. A second tension spring 89 is provided between the protruded tab 46*a* of the swing arm 46 and the side flange 31*c* of the base 31. Namely, the protruded tab 46*a* on a downstream side along the sheet feed direction Y is connected with the side flange 31*c* on an upstream side along the sheet feed direction Y by the second tension spring 89.

An operation of the evacuator 80 will be described with reference to FIG. 8A to FIG. 13B. With respect to the drawings from FIG. 8A to FIG. 13B, drawings with suffix "A" show a state where the sheet feed tray 21 is not installed in the sheet feed device 20 (the main body 11), and drawings with suffix "B" show a state where the sheet feed tray 21 is installed in the sheet feed device 20 (the main body 11). As shown in the drawings with suffix "A" (FIG. 8A to FIG. 13A), the evacuator 80 provided on a rear side of the upper surface 31*a* along the longitudinal direction of the base 31 is in a waiting state for the sheet feed tray 21 while the sheet feed tray 21 is not installed in the sheet feed device 20 (the main body 11).

Figures 8A, 8B:
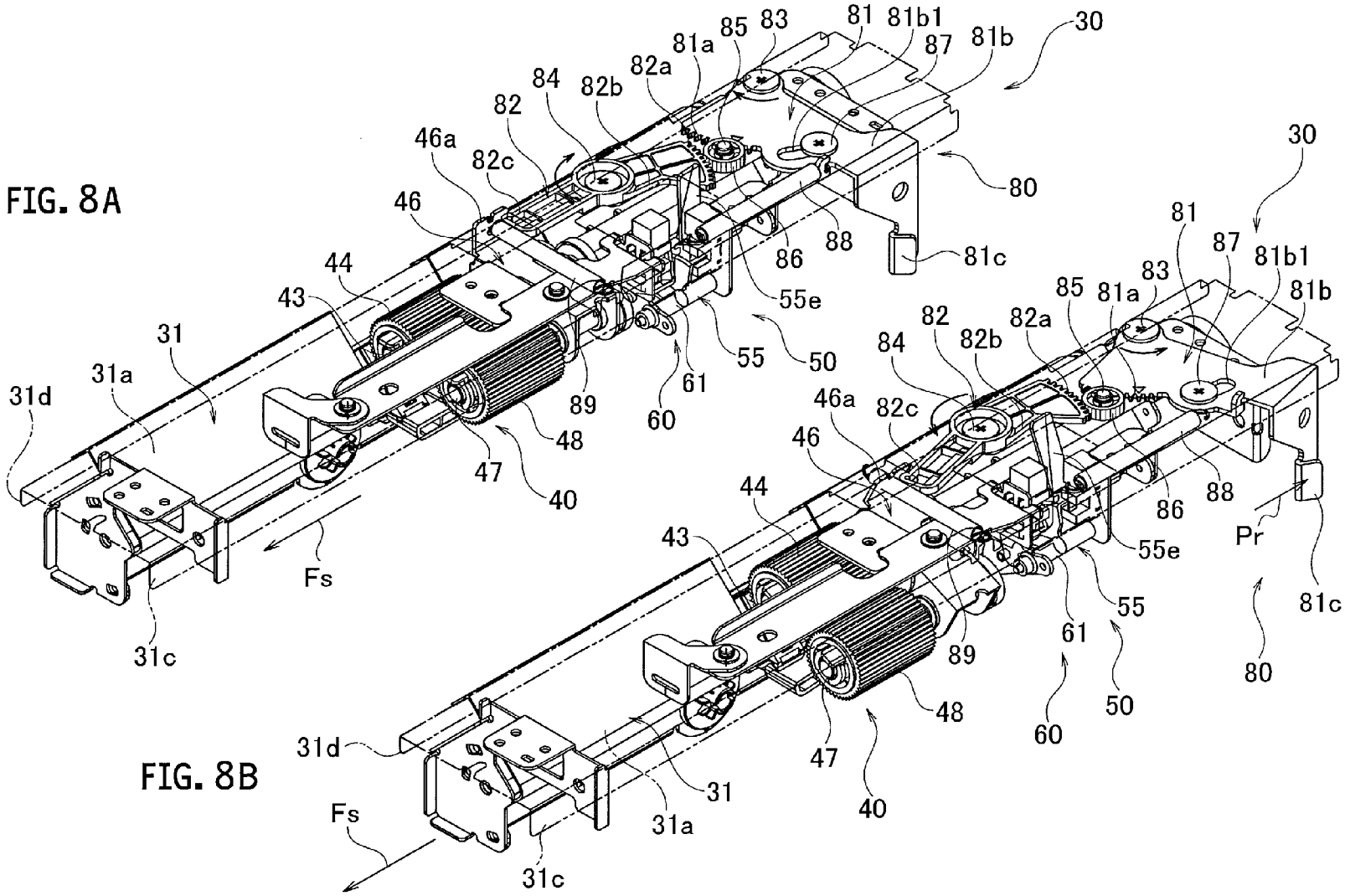
FIG. 8A is a perspective view of the sheet feed mechanism (upper side) when the sheet feed tray is not installed in the sheet feed device.
FIG. 8B is a perspective view of the sheet feed mechanism (upper side) when the sheet feed tray is installed in the sheet feed device.

While the evacuator 80 is in the waiting state as shown in FIG. 8A and FIG. 9A, the first evacuation lever 81 provided on a rear side of the upper surface 31*a* is pulled forward by the first tension spring 88. Therefore, the first evacuation lever 81 is swung to the front side about the first support axial pin 83, but its swing is restricted at its front limit position defined by the stopper pin 87 fixed on the upper surface 31*a* of the base 31 and the elongate curved hole 81*b*1 formed on the upper plate 81*b* of the first evacuation lever 81. In the waiting state, the pressed tab 81*c* is waited at a position where it is to be pressed by the sheet feed tray 21 when the sheet feed tray 21 is inserted into the sheet feed device 20 (the main body 11).

The above-described swing of the first evacuation lever 81 is transferred to the second evacuation lever 82 via the first gear 81*a*, the transfer gear 86 and the second gear 82*a*, so that the second evacuation lever 82 is swung in the same rotational direction as a rotational direction (clockwise in FIG. 9A) of the first evacuation lever 81. According to this swing of the second evacuation lever 82, the second gear 82*a* and the angled portion 82*b* are moved away from the side flange 31*d* on a downstream side along the sheet feed direction Y (i.e. moved toward the side flange 31*c* on an upstream side along the sheet feed direction Y), and the front-side portion 82*c* is moved toward the side flange 31*d* so as to be almost parallel to the side flange 31*d*.

The end of the front-side portion 82*c* of the second evacuation lever 82 contacts with the inner side of the protruded tab 46*a* of the swing arm 46, so that the protruded tab 46*a* is pushed by the front-side portion 82*c* toward the side flange 31*d* against a compressive force of the second tension spring 89. When the protruded tab 46*a* is pushed toward the side flange 31*d*, the swing arm 46 is swung about the first rotational shaft 43 so as to move the scraper roller 48 rotatably supported by the other end of the swing arm 46 upward. As the result, the scraper roller 48 is evacuated at the upper position (the evacuation position) where the scraper roller 48 never interferes drawing-out of the sheet feed tray 21 from the sheet feed device 20 (the main body 11) and inserting of the sheet feed tray 21 into the sheet feed device 20 (the main body 11).

In addition, while the sheet feed tray 21 is not installed in the sheet feed device 20 (the main body 11), the angled portion 82*b* is moved toward the side flange 31*c* on an upstream side along the sheet feed direction Y as described above. Therefore, the angled portion 82*b* contacts with the protruded tab 55*e* of the first swingable lever 55 at its rearmost portion within the above-described contact range as shown in FIG. 8A, FIG. 9A, FIG. 10A and FIG. 11A. When the protruded tab 55*e* is pushed by the rearmost portion of the angled portion 82*b* toward the side flange 31*c* on an upstream side along the sheet feed direction Y, the protruded tab 55*e* is raised vertically.

The first swingable lever 55 is swung about the shaft 54 laterally provided on the L-shaped bracket 51 against its own weight and the weight of the sheet detection wheel 56 as to raise the protruded tab 55*e* vertically. As the result, the sheet detection wheel 56 located at the opposite side to the shaft 54 is moved upward so as to be evacuated to upper position (the evacuation position) where the sheet detection wheel 56 never interferes drawing-out of the sheet feed tray 21 from the sheet feed device 20 (the main body 11) and inserting of the sheet feed tray 21 into the sheet feed device 20 (the main body 11).

Further, since the shield plate 61*c* of the second swingable lever 61 of the upper limit detector 60 can be coupled with the stepped coupling plate 55*c* of the first swingable lever 55 so as to be freely contactable with each other and freely separable from each other, the above-described swing of the first swingable lever 55 makes the second swingable lever 61 swung about the shaft 54 laterally provided on the L-shaped bracket 51 against its own weight and a weight of the upper limit detection wheel 62 by coupling of the stepped coupling plate 55*c* with the shield plate 61*c*. As the result, the upper limit detection wheel 62 located at the opposite side to the shaft 54 is moved upward so as to be evacuated to upper position (the evacuation position) where the upper limit detection wheel 62 never interferes drawing-out of the sheet feed tray 21 from the sheet feed device 20 (the main body 11) and inserting of the sheet feed tray 21 into the sheet feed device 20 (the main body 11).

As described above, while the sheet feed tray 21 is not installed in the sheet feed device 20 (the main body 11), both of the sheet detection wheel 56 and the upper limit detection wheel 62 are evacuated to the upper position (the evacuation position) where the sheet detection wheel 56 and the upper limit detection wheel 62 never interfere drawing-out (a removal) of the sheet feed tray 21 from the sheet feed device 20 (the main body 11) and inserting (an installation) of the sheet feed tray 21 into the sheet feed device 20 (the main body 11). Note that a line HL shown in FIG. 12A and FIG. 13A indicates an upper height level of the sheet feed tray 21 to be installed. Therefore, even if the height H of the sheet feed tray 21 is made higher in order to enables the accommodation of 500 sheets of thick papers or normal papers of other countries (one package unit), the evacuation of the sheet detection wheel 56 and the upper limit detection wheel 62 prevents them from contacting with the sheet feed tray 21. As the result, reliability and durability of the sheet feed device 20 can be improved.

In addition, when the height H of the sheet feed tray 21 is changed (made higher) in a case where the sheet feed device 20 is adopted to the image forming apparatus 10 similarly to the present embodiment, it is possible to adapt the change of the height H only by partially changing a setting in the sheet feed device 20 without any change in the image forming apparatus 10. As the result, costs required for changing the height H of the sheet feed tray 21 can be made low. Further, the evacuations of the sheet detection wheel 56 and the upper limit detection wheel 62 are done simultaneously and interrelatedly to each other, so that the evacuator 80 can be used partially in common by both of the sheet detector 50 and the upper limit detector 60. Furthermore, the configuration of the evacuator 80 can be made simpler by the first swingable lever 55 and the second swingable lever 61.

On the other hand, as shown in the drawings with suffix "B" (FIG. 8B to FIG. 13B), the evacuator 80 provided on a rear side of the upper surface 31*a* along the longitudinal direction of the base 31 is in an interconnecting state with the sheet feed tray 21 while the sheet feed tray 21 is installed in the sheet feed device 20 (the main body 11).

While the evacuator 80 is in the interconnecting state as shown in FIG. 8B and FIG. 9B, the pressed tab 81*c* of the first evacuation lever 81 provided on a rear side of the upper surface 31*a* is pushed backward by the sheet feed tray 21 against a compressive force of the first tension spring 88 (see arrows Pr in the drawings). Therefore, the first evacuation lever 81 is swung to the rear side about the first support axial pin 83, but its swing is restricted at its rear limit position defined by the stopper pin 87 fixed on the upper surface 31*a* of the base 31 and the elongate curved hole 81*b*1 formed on the upper plate 81*b* of the first evacuation lever 81.

The above-described swing of the first evacuation lever 81 is transferred to the second evacuation lever 82 via the first gear 81*a*, the transfer gear 86 and the second gear 82*a*, so that the second evacuation lever 82 is swung in the same rotational direction as a rotational direction (counter-clockwise in FIG. 9B) of the first evacuation lever 81. According to this swing of the second evacuation lever 82, the second gear 82*a* and the angled portion 82*b* are moved toward the side flange 31*d* on a downstream side along the sheet feed direction Y, and the front-side portion 82*c* is moved away from the side flange 31*d* (i.e. moved toward the side flange 31*c* on an upstream side along the sheet feed direction Y).

The protruded tab 46*a* of the swing arm 46 is pulled by a compressive force of the second tension spring 89, so that the protruded tab 46*a* (the swing arm 46) is moved toward the side flange 31*c* of the base 31 along with the swing of the second evacuation lever 82. Namely, the swing arm 46 including the protruded tab 46*a* is swung downward about the first rotational shaft 43 due to its own weight and weights of the scraper roller 48 and the second rotational shaft 47, so that the scraper roller 48 rotatably supported by the other end of the swing arm 46 falls onto the uppermost paper Pu so as to contact with the uppermost paper Pu.

In addition, while the sheet feed tray 21 is installed in the sheet feed device 20 (the main body 11), the angled portion 82*b* is moved toward the side flange 31*d* on a downstream side along the sheet feed direction Y as described above. Therefore, the angled portion 82*b* contacts with the protruded tab 55*e* of the first swingable lever 55 at its foremost portion (near its vertex) within the above-described contact range as shown in FIG. 8B, FIG. 9B, FIG. 10B and FIG. 11B. The protruded tab 55*e* is not pushed forcibly by the foremost portion of the angled portion 82*b*, but the first swingable lever 55 including the protruded tab 55*e* swings about the shaft 54 laterally provided on the L-shaped bracket 51 due to its own weight and a weight of the sheet detection wheel 56. As the result, the sheet detection wheel 56 located at the opposite side to the shaft 54 falls onto the uppermost paper Pu so as to contact with the uppermost paper Pu.

Further, since the shield plate 61*c* of the second swingable lever 61 of the upper limit detector 60 can be coupled with the stepped coupling plate 55*c* of the first swingable lever 55 so as to be freely contactable with each other and freely separable from each other, the second swingable lever 61 swung about the shaft 54 laterally provided on the L-shaped bracket 51 due to its own weight and a weight of the upper limit detection wheel 62 along with the above-described swing of the first swingable lever 55. As the result, the upper limit detection wheel 62 located at the opposite side to the shaft 54 is falls onto the uppermost paper Pu so as to contact with the uppermost paper Pu.

Here, operations of the sheet detector 50 and the upper limit detector 60 are shown in a Table 1.

TABLE 1

| No. | Sheet Feed Tray 21 | Paper P | Bottom Plate 25 | Sheet Detection Wheel 56 | Upper Limit Detection Wheel 62 |
|---|---|---|---|---|---|
| 1 | Not Installed | — | — | Evacuated | Evacuated |
| 2 | Installed | Not Set | Not Lifted Up | Lowermost | Lowermost |
| 3 | Installed | Set (One Sheet) | Lifted Up (Uppermost) | On Paper P | On Paper P |
| 4 | Installed | Not Set | Lifted Up (Uppermost) | Fall Into Through Hole 25a | On Bottom Plate 25 |
| 5 | Installed | Not Set | Lifted Down | Separated From Bottom Plate 25 | Separated From Bottom Plate 25 |

With respect to No. 1, the sheet feed tray 21 is not installed in the sheet feed device 20 (the main body 11). Both of the sheet detection wheel 56 and the upper limit detection wheel 62 are evacuated upward. Therefore, it is possible to make the height H of the sheet feed tray 21 higher, so that 500 sheets of thick papers or normal papers of other countries can be set on the sheet feed tray 21 (by adjusting the upper limit position).

With respect to No. 2, the sheet feed tray 21 is installed in the sheet feed device 20 (the main body 11), but no Paper P is set on the sheet feed tray 21. Before the bottom plate 25 is lifted up, the upper limit detection wheel 62 (and the sheet detection wheel 56) is moved downward by the evacuator 80, due to the installation of the sheet feed tray 21, from the upper position (the evacuation position) in order to detect the upper limit position for papers P (but no paper P is set in this case). Therefore, the sheet detection wheel 56 and the upper limit detection wheel 62 are move down to their lowermost positions (hanged in the air) in this case (in this state).

With respect to No. 3, the sheet feed tray 21 is installed in the sheet feed device 20 (the main body 11), and one sheet of paper P is set on the sheet feed tray 21. The bottom plate 25 is already lifted up to the upper limit position. Both of the sheet detection wheel 56 and the upper limit detection wheel 62 are contacted with the paper P (i.e. the uppermost paper Pu). The bottom plate 25 is lifted up to the upper limit position in this case, because only one paper P is set on the sheet feed tray 21. If some sheets of papers P are set on the sheet feed tray 21, the bottom plate 25 is lifted up and then stopped at a position that makes the uppermost paper Pu positioned at the upper limit position.

With respect to No. 4, the sheet feed tray 21 is installed in the sheet feed device 20 (the main body 11), but all papers P are wasted. Since all papers P are just wasted, the bottom plate 25 is lifted up to the upper limit position. Therefore, the sheet detection wheel 56 falls into the through hole 25*a* formed on the bottom plate 25 as shown in FIG. 6B. Namely, "paper empty" is detected. The upper limit detection wheel 62 is contacted with the bottom plate 25. Namely, the bottom plate 25 is positioned at the upper limit position as described above.

With respect to No. 5, the sheet feed tray 21 is installed in the sheet feed device 20 (the main body 11), and the bottom plate 25 is lifted down after the detection of "paper empty". According to lifting-down of the bottom plate 25, both of the sheet detection wheel 56 and the upper limit detection wheel 62 are separated from the bottom plate 25. Since both of the sheet detection wheel 56 and the upper limit detection wheel 62 are distance away from the bottom plate 25, the sheet detection wheel 56 and the upper limit detection wheel 62 can be prevented from being damaged. Note that the sheet detection wheel 56 and the upper limit detection wheel 62 are evacuated after the detection of "paper empty" in preparation for drawing-out of the sheet feed tray 21 from the sheet feed device 20 (the main body 11).

The operations Nos. 1 to 5 are controlled by the controller 16 shown in FIG. 1, so that the operations can be carried out without any fail.

The present invention is not limited to the above-mentioned embodiment and modified examples, and it is possible to embody the present invention by modifying its components in a range that does not depart from the scope thereof. Further, it is possible to form various kinds of inventions by appropriately combining a plurality of components disclosed in the above-mentioned embodiment and modified examples. For example, it may be possible to omit several components from all of the components shown in the above-mentioned embodiment.

The present application claims the benefit of a priority under 35 U.S.C. §119 to Japanese Patent Application No. 2014-165784, filed on Aug. 18, 2014, the entire content of which is incorporated herein by reference.

What is claimed is:

1. A sheet feed device comprising:

a sheet feed tray that is installable in the sheet feed device and removable from the sheet feed device;

a bottom plate that is provided in the sheet feed tray, and is capable of being lifted up together with one or more papers stacked thereon so as to make a leading portion of an uppermost paper positioned at an upper limit position when the sheet feed tray is installed in the sheet feed device;

a base that is provided within the sheet feed device, and to which a sheet feeder, a sheet detection member and an upper limit detection member are attached;

the sheet feeder is configured to feed out the papers stacked on the bottom plate sequentially from the sheet feed tray;

the sheet detection member is configured to detect whether or not at least one paper is stacked on the sheet feed tray by a contact detection with the paper;

the upper limit detection member is configured to detect whether or not the leading portion of the uppermost paper is positioned at the upper limit position by a contact detection with the uppermost paper; and an evacuator that evacuates both the sheet detection member and the upper limit detection member to an evacuation position where the sheet detection member and the upper limit detection member never interfere with a removal of the sheet feed tray from the sheet feed device and an installation of the sheet feed tray in the sheet feed device, wherein the sheet feeder, the sheet detection member and the upper limit detection member are positioned above the sheet feed tray, and laterally spaced from one another, the sheet detection member is swingably attached to the base by a first swingable lever so as to be swung downward due to its own weight, the upper limit detection member is swingably attached to the base by a second swingable lever so as to be swung downward due to its own weight, the second swingable lever is coupled with the first swingable lever so as to be freely contactable with each other and freely separable from each other, and the upper limit detection member is evacuated to the evacuation position simultaneously and interrelatedly to an evacuation of the sheet detection member to the evacuation position by coupling of the second swingable lever with the first swingable lever.

* * * * *